US009282613B2

(12) United States Patent
Meng et al.

(10) Patent No.: US 9,282,613 B2
(45) Date of Patent: Mar. 8, 2016

(54) PIXEL UNIT DRIVING CIRCUIT AND DRIVING METHOD, PIXEL UNIT AND DISPLAY APPARATUS

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Qingchao Meng, Beijing (CN); Xiaoyan Liu, Beijing (CN); Wenjie Wang, Beijing (CN); Xiaojun Su, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 14/355,041

(22) PCT Filed: Mar. 29, 2013

(86) PCT No.: PCT/CN2013/073484

§ 371 (c)(1),
(2) Date: Apr. 29, 2014

(87) PCT Pub. No.: WO2014/127555

PCT Pub. Date: Aug. 28, 2014

(65) Prior Publication Data

US 2014/0346968 A1 Nov. 27, 2014

(30) Foreign Application Priority Data

Feb. 22, 2013 (CN) ..... 2013 1 0057327

(51) Int. Cl.
*G09G 3/32* (2006.01)
*H05B 33/08* (2006.01)

(52) U.S. Cl.
CPC ..... *H05B 33/0896* (2013.01); *G09G 3/3233* (2013.01); *G09G 2300/0819* (2013.01); *G09G 2300/0842* (2013.01); *G09G 2310/0262* (2013.01); *G09G 2320/045* (2013.01)

(58) Field of Classification Search
CPC ..... H05B 33/0896; G09G 3/3233; G09G 2300/0819; G09G 2300/0842; G09G 2310/0262; G09G 2320/045
USPC ..... 345/76–83, 204, 690; 315/169.3
See application file for complete search history.

(56) References Cited

U.S. PATENT DOCUMENTS

2006/0061526 A1* 3/2006 Shirasaki et al. ..... 345/77
2011/0273419 A1 11/2011 Park et al.

FOREIGN PATENT DOCUMENTS

CN 102651198 A 8/2012
CN 102890910 A 1/2013
CN 203118413 U 8/2013
WO 02/067327 A2 8/2002

OTHER PUBLICATIONS

International Search Report dated Dec. 11, 2013; PCT/CN2013/073484.
First Chinese Office Action dated Aug. 5, 2014, Appln. No. 201310057327.8.
Written Opinion of the International Searching Authority dated Nov. 14, 2013; PCT/CN2013/073484.

* cited by examiner

*Primary Examiner* — Stephen Sherman
(74) *Attorney, Agent, or Firm* — Ladas & Parry LLP

(57) ABSTRACT

There are provided a pixel unit driving circuit and driving method, pixel unit and display apparatus. The pixel unit driving circuit is used for driving a light-emitting device to emit light, and comprises a first thin film transistor (T1), a second thin film transistor (T2), a third thin film transistor (T3) and a storage capacitor (Cs). A gate of the first thin film transistor (T1) is connected with a control line (Gate), a first electrode thereof is connected with a data line (Data), and a second electrode thereof is connected with a first node (A). One gate of the second thin film transistor (T2) is connected with the control line (Gate) and the other gate is connected with a second scan line (Scan2), a first electrode thereof is connected with the storage capacitor (Cs), and a second electrode thereof is connected with a second node (B). One gate of the third thin film transistor (T3) is connected with the first node (A) and the other gate is connected with the second scan line (Scan2), a first electrode thereof is connected with a power supply (Vdd), and a second electrode thereof is connected with the second node (B). One terminal of the storage capacitor is connected with the first node (A), and the other terminal is connected with the first electrode of the second thin film transistor (T2). One terminal of the light-emitting device is connected with the second node (B), and the other terminal thereof is grounded. The pixel unit driving circuit can reduce an influence on a driving voltage caused by variations in threshold voltage.

18 Claims, 5 Drawing Sheets

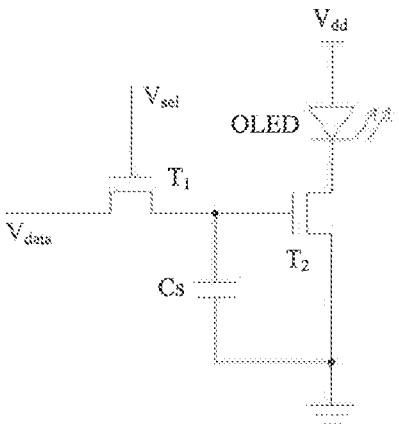

Fig.1 (Prior Art)

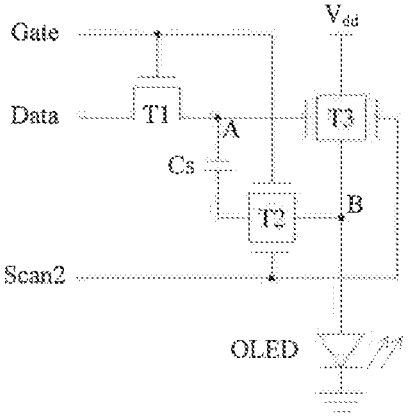

Fig.2 turning on the first thin film transistor and the second thin film transistor, charging the storage capacitor, and making the third thin film transistor start to be turned on when a voltage across the storage capacitor reaches a threshold voltage of the third thin film transistor — s101

↓ keeping the second thin film transistor turned on while turning off the first thin film transistor, so that the third thin film transistor is turned on continually to make the light-emitting device start to emit light and kept to emit light — s102

Fig.3

PIXEL UNIT DRIVING CIRCUIT AND DRIVING METHOD, PIXEL UNIT AND DISPLAY APPARATUS

TECHNICAL FIELD

The present disclosure relates to a field of display driving technique, and particularly, to a pixel unit driving circuit and driving method, the pixel unit and a display apparatus.

BACKGROUND

An Organic Light-Emitting Diode (OLED) display, which is also called as an organic electroluminescent display, is an emerging panel display device. It has a wide application prospect because it has various advantages, such as simple preparation processes, low cost, low power consumption, high brightness of light emitting, wide adaption scope of operation temperature, light and thin cubage, rapid response speed, being apt to realize a color display and a large screen display, being apt to be matched with a Gate on Array, being apt to realize a flexible display, and the like.

The OLED pixel units in the organic electroluminescent display are generally arranged in a matrix, and may be classified into two driving modes of a Passive Matrix-Organic Light Emission Display (referred to as a PM-OLED briefly) driving mode and an Active Matrix-Organic Light Emission Display (referred to as an AM-OLED briefly) driving mode, according to their different driving modes in the driving circuit for the OLED pixel unit. Herein, the PM-OLED driving mode fails to satisfy requirements for the display with a high resolution and a large size because it has disadvantages of crosstalk, high power consumption, short lifespan, etc., although its process is simple and cost is low. As compared, the AM-OLED driving mode integrates a set of thin film transistors (referred to as TFTs briefly) and a storage capacitor in each pixel unit, in order to compose the pixel unit pixel unit driving circuit, and realizes controlling of a current passing through the OLED by a driving control of the TFT, so that the OLED emits light. Because of the addition of the TFTs and the storage capacitor, the OLED in the pixel unit driving circuit may always emit light within a controllable period of one frame, and the required driving current is small, the power consumption is low and the lifespan is longer, which may satisfy the requirements for the large size display with the high resolution and multiple grey scales. Meanwhile, the AM-OLED has obvious advantages in many aspects like angle of view, restoring of colors, the power consumption, the response time and the like, and is applicable to the display device with high information amount and high resolution.

As illustrated in FIG. 1, the exiting AM-OLED pixel unit driving circuit utilizes generally a structure of 2T1C, that is, it comprises two thin film transistors and one storage capacitor, which are a switch transistor $T_1$, a driving transistor $T_2$ and the storage capacitor Cs, respectively. The driving mode thereof may comprise two stages, namely, a data writing stage and a data retaining stage.

During the data writing stage, a scan line of the AM-OLED driving circuit outputs a row selection signal $V_{Sel}$ to select a row at which the switch transistor $T_1$ locates, so that the switch transistor $T_1$ is turned on, a data voltage $V_{data}$ outputted from a data line of the selected row enters into the pixel unit via the switch transistor $T_1$ and charges the storage capacitor Cs. With the gradually increasing of potential at a gate of the driving transistor $T_2$, the driving transistor $T_2$ starts to be turned on. During a stable programming stage, the driving transistor $T_2$ operates in a saturation zone, and the output current (that is, a current passing through the OLED) of the driving transistor $T_2$ is as follows, according to a source-drain current formula for the saturation zone of the TFT:

$$I_{T_2} = I_{OLED} = \frac{1}{2}\mu_n C_{ox}\frac{W}{L}(V_{GS} - V_{th})^2. \quad (1)$$

In the Equation (1), $\mu_n$ is an electron mobility, $C_{ox}$ is the capacitance at the insulation side of the OLED per unit area, W is a channel width of the driving transistor $T_2$, L is a channel length of the driving transistor $T_2$, $V_{GS}$ is a gate-source voltage of the driving transistor $T_2$, and $V_{th}$ is a threshold voltage of the driving transistor $T_2$.

During the data retaining stage, the row select signal $V_{Sel}$ outputted from the scan line of the AM-OLED driving circuit does not select the row at which the switch transistor $T_1$ locates, so that the switch transistor $T_1$ is turned off. At this time, the potential at the gate of the driving transistor $T_2$ is kept unchanged because of an effect of charges stored in the storage capacitor Cs, and thus the driving transistor $T_2$ is kept to be in a turn-on state. Meanwhile, the OLED emits light to realize gray scales under a control of a given power supply voltage $V_{dd}$, and the OLED is kept to be driven continuously during the data retaining stage.

It can be seen from the current expression (namely the Equation (1)) of the OLED, this current not only is controlled by the data voltage $V_{data}$, but also is affected by the threshold voltage $V_{th}$ of the driving transistor $T_2$, that is to say, the existing 2T1C structure fails to compensate for a shift or an inconsistency of the threshold voltage $V_{th}$. Because it is impossible for the driving transistors $T_2$ in the respective pixel unit driving circuits to have completely consistent performance parameters, and the threshold voltage $V_{th}$ of the driving transistor $T_2$ in the respective pixel unit driving circuits are not compensated for, the currents flowing through the OLEDs in the respective pixel units would be inconsistent, such that the brightness of the light emitted from the respective pixel units are non-uniform, which leads to a non-uniformity in the brightness of the whole display screen and in turn affects a display effect. Further, because the currents flowing through the OLEDs in the respective pixel units have a non-linear relationship with the data voltage $V_{data}$, it is not benefit for adjusting the gray scales in the whole display screen.

SUMMARY

Technique problems to be settled in the present disclosure are to provide a driving circuit and a driving method for a pixel unit, the pixel unit and a display apparatus, which are capable of decreasing or eliminating an influence on a driving voltage caused by variations in a threshold voltage, in view of the above overcome in the prior art.

In one embodiment of the present disclosure, the above technique problems are settled by following solutions.

A pixel unit driving circuit for driving a light-emitting device to emit light, comprises a first thin film transistor, a second thin film transistor, a third thin film transistor and a storage capacitor, wherein the first to third thin film transistors comprise gates, first electrodes and second electrodes;

the gate of the first thin film transistor is connected with a control line, the first electrode thereof is connected with a data line, and the second electrode thereof is connected with a first node;

the second thin film transistor has two gates, one is connected with the control line and the other one is connected with a second scan line, the first electrode thereof is connected with the storage capacitor, and the second electrode thereof is connected with a second node;

the third thin film transistor has two gates, one is connected with the first node and the other one is connected with the second scan line, the first electrode thereof is connected with a power supply, and the second electrode thereof is connected with the second node;

one terminal of the storage capacitor is connected with the first node, and the other terminal thereof is connected with the first electrode of the second thin film transistor; and one terminal of the light-emitting device is connected with the second node, and the other terminal thereof is grounded.

Optionally, the first node is connected with the control line.

Optionally, the driving circuit further comprises a fourth thin film transistor having a gate, a first electrode and a second electrode, wherein the gate of the fourth thin film transistor is connected with the first scan line, the first electrode thereof is connected with the second node, and the second electrode thereof is grounded.

Optionally, all of the thin film transistors are N-type thin film transistors; and/or the light-emitting device is an Organic Light-Emitting Diode.

In one embodiment of the present disclosure, there is further provided a driving method for a pixel unit, which is applied to the above pixel unit driving circuit, comprising steps of:

A1, turning on the first thin film transistor and the second thin film transistor, charging the storage capacitor, and causing the third thin film transistor to start to be turned on when a voltage across the storage capacitor reaches a threshold voltage of the third thin film transistor; and A2, keeping the second thin film transistor being turned on while turning off the first thin film transistor, so that the third thin film transistor is turned on continually and the light-emitting device starts to emit light and keep to emit light.

Optionally, all of the first to third thin film transistors are N-type thin film transistors.

The step A1 comprises:

inputting high level signals through the control line and the data line, while inputting a low level signal through the second scan line.

The step A2 comprises:

inputting a low level signal through the control line, while inputting high level signals through the data line and the second scan line.

Optionally, the pixel unit driving circuit further a first node connected with the control line; the driving method further comprises a step B1, before the step A1: turning on the first thin film transistor and the second thin film transistor and pre-charging the first thin film transistor, so that the first node has an initial voltage.

Optionally, all of the first to third thin film transistors are N-type thin film transistors.

The step B1 comprises:

inputting a high level signal through the control line, while inputting low level signals through the data line and the second scan line.

Optionally, the pixel unit driving circuit further comprises a fourth thin film transistor having a gate, a first electrode and a second electrode; the gate of the fourth thin film transistor is connected with the first scan line, the first electrode thereof is connected with the second node and the second electrode thereof is grounded; the driving method further comprises a step C1, before the step B1: turning off the first thin film transistor and the second thin film transistor while turning on the fourth thin film transistor, so that a voltage at the second node is zero.

Optionally, all of the first to fourth thin film transistors are N-type thin film transistors.

The step C1 comprises:

inputting a high level signal through the first scan line, while inputting low level signals through the control line, the data line and the second control line.

In one embodiment of the present disclosure, there is further provided a pixel unit comprising a light-emitting device and the above pixel unit driving circuit connected with the light-emitting device.

In one embodiment of the present disclosure, there is further provided a display apparatus comprising a plurality of above pixel units arranged in a matrix.

The embodiments of the present disclosure may achieve benefit effects as follows.

Because the pixel unit driving circuit according to the embodiments of the present disclosure utilizes a structure of 4T1C (that is, it comprises the first to fourth thin film transistors and the one storage capacitor), it may reduce or even eliminate an influence on the driving voltage of the light-emitting device (OLED) caused by the variations in the threshold voltage of the third thin film transistor (namely a driving transistor), so that the driving voltage and a driving current of the light-emitting device are ensured to be stable, the light-emitting device in each pixel unit is also ensured to display normally, and in turn an uniformity of a whole display panel is ensured thereby a quality of the display apparatus is enhanced.

BRIEF DESCRIPTION OF THE DRAWINGS

FIG. 1 is a schematic diagram illustrating a structure of an AM-OLED pixel unit driving circuit in the prior art;

FIG. 2 is a schematic diagram illustrating a structure of a pixel unit driving circuit according to an Embodiment 1 of the present disclosure;

FIG. 3 is a flowchart illustrating a pixel unit driving method according to the Embodiment 1 of the present disclosure;

In Drawings:

Figure 4:
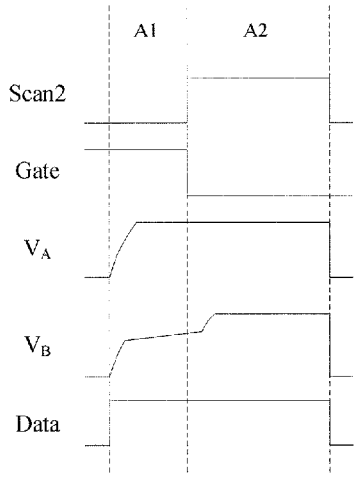
FIG. 4 is a timing control diagram of the pixel unit driving circuit shown in FIG. 2.

T1—first thin film transistor; T2—second thin film transistor; T3—third thin film transistor; T4—fourth thin film transistor; OLED—Organic Light-Emitting Diode; Cs—storage capacitor; A—first node; B—second node; Gate—control line; Data—data line; Scan1—first scan line; Scan2—second scan line.

DETAILED DESCRIPTION

In order to make those skilled in the art to better understand solutions of the embodiments of the present disclosure, the pixel unit driving circuit and the pixel unit driving method, the pixel unit and the display apparatus will be described in details below in connection with the drawings.

Embodiment 1

As illustrated in FIG. 2, the present embodiment provides a pixel unit driving circuit, which is used for driving a light-emitting device to emit light and comprises a first thin film transistor T1, a second thin film transistor T2, a third thin film transistor T3 and a storage capacitor Cs.

In FIG. 2, the first thin film transistor T1 comprises a gate, a first electrode and a second electrode; the gate thereof is connected with a control line Gate, the first electrode thereof is connected with a data line Data, and the second electrode thereof is connected with a first node A.

The second thin film transistor T2 comprises two gates, a first electrode and a second electrode. That is, the second thin film transistor T2 is a dual-gate TFT, one of the two gates is connected with the control line Gate and the other gate is connected with a second scan line Scan2, the first electrode thereof is connected with the storage capacitor Cs, and the second electrode thereof is connected with a second node B.

The third thin film transistor T3 comprises two gates, a first electrode and a second electrode. That is, the third thin film transistor T3 is a dual-gate TFT, one of the two gates is connected with the first node A and the other gate is connected with the second scan line Scan2, the first electrode thereof is connected with a power supply $V_{dd}$, and the second electrode thereof is connected with the second node B.

One terminal of the storage capacitor Cs is connected with the first node A, and the other terminal thereof is connected with the first electrode of the second thin film transistor T2.

One terminal of the light-emitting device is connected with the second node B, and the other terminal thereof is grounded.

Optionally, all of the first to the third thin film transistors may be N-type thin film transistors. The N-type thin film transistor has a characteristic of being turned on when a high level signal is inputted to the gate while being turned off when a low level signal is inputted to the gate.

Optionally, the light-emitting device may be an Organic Light-Emitting Diode (OLED).

Optionally, all of the first electrodes of the first to third thin film transistors may be sources, and the second electrodes may be drains; alternatively, all of the first electrodes of the first to third thin film transistors may be drains, and the second electrodes may be sources.

The present embodiment further provides a pixel unit comprising a light-emitting device and the aforementioned pixel unit driving circuit connected therewith.

The present embodiment further provides a display apparatus comprising a plurality of above pixel units distributed in a matrix.

As illustrated in FIG. 3, the present embodiment further provides a pixel unit driving method, which is applied to the above pixel unit driving circuit, and the driving method performs operating processes as follows.

In a step s101, the first thin film transistor T1 and the second thin film transistor T2 are turned on, the storage capacitor Cs is charged, and the third thin film transistor T3 is started to be turned on when a voltage across the storage capacitor Cs reaches a threshold voltage $V_{th(T3)}$ of the third thin film transistor T3.

In particular, high level signals are inputted through the control line Gate and the data line Data, while a low level signal is inputted through the second scan line Scan2.

In a step s102, the second thin film transistor T2 is kept turning on, while the first thin film transistor T1 is turned off, so that the third thin film transistor T3 is turned on continually to make the light-emitting device start to emit light and kept to emit light.

In particular, the low level signal is inputted through the control line Gate, while the high level signals are inputted through the data line Data and the second scan line Scan2.

An operation principle of the pixel unit driving circuit and the driving method according to the present embodiment will be described below in connection with the timing control diagram shown in FIG. 4.

The timing control diagram shown in FIG. 4 may be divided into two stages, a data writing stage and a driving and light-emitting stage, respectively, which are marked as A1 and A2 in FIG. 4, respectively, and an OLED is used as the light-emitting device.

Stage A1 (Data Writing Stage)

The high level signals are inputted through the control line Gate and the data line Data, while the low level signal is inputted through the second scan line Scan2, so that the first thin film transistor T1 and the second thin film transistor T2 are turned on, the high level signal input through the data line Data starts to charge the storage capacitor Cs, and the third thin film transistor T3 is caused to start to be turned on when the voltage across the storage capacitor Cs reaches the threshold voltage $V_{th(T3)}$ of the third thin film transistor T3. At this stage, all of the first to third thin film transistors operate in a linear zone, and a voltage at the first node A is $$V_A = V_{Data}. \tag{2}$$

In the Equation (2), $V_{Data}$ represents a voltage outputted from the data line Data and is called as a data voltage briefly.

A voltage at the second node B is $$V_B = V_A - V_{th(T3)} - V_{OLED} = V_{Data} - V_{th(T3)} - \frac{C_{OLED} \cdot V_{Data}}{C_{OLED} + Cs} = -V_{th(T3)} + \frac{Cs \cdot V_{Data}}{C_{OLED} + Cs}. \tag{3}$$

In the Equation (3), $V_{OLED}$ represents an effect on the data voltage $V_{Data}$ caused by a capacitor $C_{OLED}$ of the OLED per se when the OLED has not emitted light.

The voltage across the storage capacitor Cs is $$\begin{aligned} V_{Cs} &= V_{GS(T3)} \\ &= V_A - V_B \\ &= V_{Data} - \left(-V_{th(T3)} + \frac{Cs \cdot V_{Data}}{C_{OLED} + Cs}\right) \\ &= V_{th(T3)} + \frac{C_{OLED} \cdot V_{Data}}{C_{OLED} + Cs}. \end{aligned} \tag{4}$$

In the Equation (4), $V_{GS}$ is a gate-source voltage of the third thin film transistor T3. It can be seen from the Equation (4) that the voltage across the storage capacitor Cs may be affected by the variations in the threshold voltage $V_{th(T3)}$ of the third thin film transistor T3. For the OLED, a capacitance at the insulation side per unit area is generally 25 nF/cm$^2$, the light-emitting area is 100 μm*200 μm, so that the capacitor of the OLED is generally about 5 pF, and a capacitance of the storage capacitor Cs is generally smaller than 1 pF.

Stage A2 (Driving and Light-Emitting Stage)

The low level signal is inputted through the control line Gate, while the high level signals are inputted through the data line Data and the second scan line Scan2, so that the second thin film transistor T2 and the third thin film transistor T3 are kept turning on continually while the first thin film transistor T1 is turned off. At this time the light-emitting device starts to emit light, and is kept turning on within a displaying period of one frame of image because charges stored on the storage capacitor Cs maintain a gate voltage of the third thin film transistor T3 continually. At this stage, the second thin film transistor T2 operates in the linear zone, and the third thin film transistor T3 operates in a saturation zone, and a current for driving the OLED to emit light (namely a driving current of the OLED) is $$\begin{aligned} I_{OLED} &= \beta\cdot(V_{GS(T3)} - V_{th(T3)})^2 \\ &= \beta\cdot\left(V_{th(T3)} + \frac{C_{OLED}\cdot V_{Data}}{C_{OLED}+Cs} - V_{th(T3)}\right)^2 \\ &= \beta\cdot\left(\frac{C_{OLED}\cdot V_{Data}}{C_{OLED}+Cs}\right)^2. \end{aligned} \tag{5}$$

In the Equation (5), $$\beta = \frac{1}{2}\mu_n C_{ox}\frac{W}{L},\ \mu_n$$

is an electron mobility, $C_{ox}$ is the capacitance at the insulation side of the OLED per unit area, W is a channel width of the third thin film transistor T3, and L is a channel length of the third thin film transistor T3. It can be seen from the Equation (5) that the driving current of the OLED is independent of the threshold voltage $V_{th(T3)}$ of the third thin film transistor T3, and is not affected by its variations. Therefore the pixel unit driving circuit and the driving method according to the present embodiment ensure that the driving voltage and the driving current of the OLED (the light-emitting device) are stable to ensure the uniformity of the whole display panel and enhance the quality of the display apparatus.

It should be noted that FIG. 4 only illustrates a part of the timing control diagrams of the pixel unit driving circuit, and the control line Gate, the data line Data and the second scan line Scan2 will repeat the input timings of the stage A1 and the stage A2 every time the display apparatus displays one frame of image, and so forth.

Embodiment 2

Figure 5:
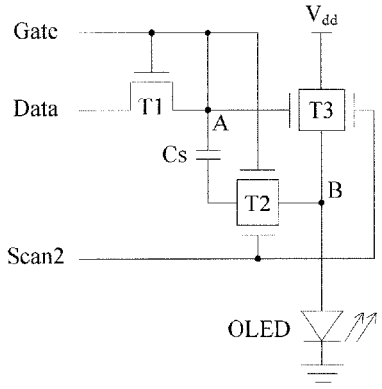
FIG. 5 is a schematic diagram illustrating a structure of a pixel unit driving circuit according to an Embodiment 2 of the present disclosure.

As illustrated in FIG. 5, the present embodiment provides a pixel unit driving circuit, which is used for driving the OLED to emit light.

The pixel unit driving circuit according to the present embodiment is different from the pixel unit driving circuit according to Embodiment 1 in that: the first node A is connected with the control line Gate.

The present embodiment further provides a pixel unit comprising OLED and the above pixel unit driving circuit connected therewith.

The present embodiment further provides a display apparatus comprising a plurality of above pixel units arranged in a matrix.

Figure 6:
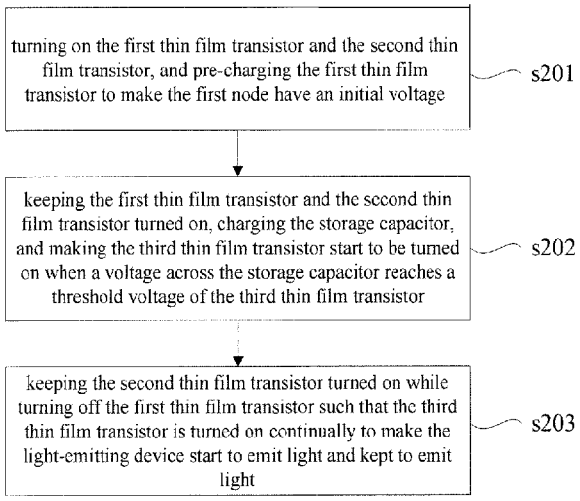
FIG. 6 is a flowchart illustrating a pixel unit driving method according to the Embodiment 2 of the present disclosure.

As illustrated in FIG. 6, the present embodiment further provides a pixel unit driving method, which is applied to the above pixel unit driving circuit, and the driving method performs operating processes as follows.

In a step s201, the first thin film transistor T1 and the second thin film transistor T2 are turned on, and the first thin film transistor is pre-charged to make the first node A have an initial voltage.

In particular, the high level signal is inputted through the control line Gate, while the low level signals is inputted through the data line Data and the second scan line Scan2.

In a step S202, the first thin film transistor T1 and the second thin film transistor T are kept turning on, the storage capacitor Cs is charged, and the third thin film transistor T3 is started to be turned on when a voltage across the storage capacitor Cs reaches a threshold voltage $V_{th(T3)}$ of the third thin film transistor T3.

In particular, the high level signals are inputted through the control line Gate and the data line Data, while the low level signal is inputted through the second scan line Scan2.

In a step s203, the second thin film transistor T2 is kept turning on, while the first thin film transistor T1 is turned off such that the third thin film transistor T3 is turned on continually to make the light-emitting device start to emit light and kept to emit light.

In particular, the low level signal is inputted through the control line Gate, while the high level signals are inputted through the data line Data and the second scan line Scan2.

An operation principle of the driving circuit and the driving method for the pixel unit according to the present embodiment will be described below in connection with the timing control diagram shown in FIG. 7.

Figure 7:
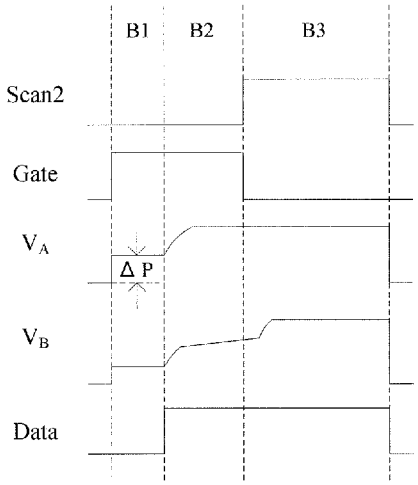
FIG. 7 is a timing control diagram of the pixel unit driving circuit shown in FIG. 5.

The timing control diagram shown in FIG. 7 is divided into three stages, a pre-charging stage, a data writing stage, and a driving and light-emitting stage, respectively, which are marked as B1 , B2 and B3 in FIG. 7, respectively.

Stage B1 (Pre-charging Stage)

The high level signal is inputted through the control line Gate, while the low level signals is inputted through the data line Data and the second scan line Scan2, so that the first thin film transistor T1 and the second thin film transistor T2 are turned on to start to pre-charge the first thin film transistor T1, and the high level signal inputted from the control line Gate makes the first node A have the initial voltage ΔP.

At this time, a voltage at the first node A is:

$$V_A = \Delta P. \tag{6}$$

A voltage at the second node B is:

$$V_B = \Delta P - V_{th(T3)}. \tag{7}$$

Per-charging the first thin film transistor T1 may prevent the shift of the voltage at the first node A caused by the effect of the threshold voltage $V_{th(T3)}$ of the third thin film transistor T3 when the first thin film transistor T1 is turned on, which may in turn affect the voltage at the gate of the third thin film transistor T3.

Stage B2 (Data Writing Stage)

The high level signals are inputted through the control line Gate and the data line Data, while the low level signal is inputted through the second scan line Scan2, so that the first thin film transistor T1 and the second thin film transistor T2 are turned on continually, the storage capacitor Cs is started to be charged by the high level signal inputted through the data line Data, and the third thin film transistor T3 is started to be turned on when the voltage across the storage capacitor Cs reaches the threshold voltage $V_{th(T3)}$ of the third thin film transistor T3. At this stage, all of the first to third thin film transistors operate in the linear zone, and the voltage at the first node A is:

$$V_A = \Delta P + V_{Data}. \tag{8}$$

The voltage at the second node B is:

$$\begin{aligned} V_B &= V_A - V_{th(T3)} - V_{OLED} \\ &= \Delta P + V_{Data} - V_{th(T3)} - \frac{C_{OLED} \cdot V_{Data}}{C_{OLED} + Cs} \\ &= \Delta P - V_{th(T3)} + \frac{Cs \cdot V_{Data}}{C_{OLED} + Cs}. \end{aligned} \tag{9}$$

The voltage across the storage capacitor Cs is:

$$\begin{aligned} V_{Cs} &= V_{GS(T3)} \\ &= V_A - V_B \\ &= \Delta P + V_{Data} - \left(\Delta P - V_{th(T3)} + \frac{Cs \cdot V_{Data}}{C_{OLED} + Cs}\right) \\ &= V_{th(T3)} + \frac{C_{OLED} \cdot V_{Data}}{C_{OLED} + Cs}. \end{aligned} \tag{10}$$

Stage B3 (Driving and Light-Emitting Stage)

This stage is completely identical with the stage A2 of the Embodiment 1, and details are omitted herein.

It should be noted that FIG. 7 only illustrates a part of the timing control diagram of the pixel unit driving circuit, and the control line Gate, the data line Data and the second scan line Scan2 will repeat the input timing of the stage B1 , the stage B2 and the stage B3 every time the display apparatus displays one frame of image, and so forth.

Other method and functions in the present embodiment are same as those in the Embodiment 1, and details are omitted herein.

Embodiment 3

Figure 8:
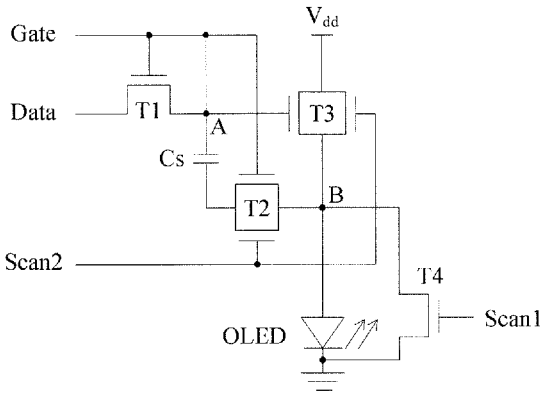
FIG. 8 is a schematic diagram illustrating a structure of a pixel unit driving circuit according to an Embodiment 3 of the present disclosure.

As illustrated in FIG. 8, the present embodiment provides a pixel unit driving circuit, which is used for driving an OLED to emit light.

The pixel unit driving circuit according to the present embodiment is different from the pixel unit driving circuit according to the Embodiment 1 in that: the driving circuit further comprises a fourth thin film transistor T4 having a gate, a first electrode and a second electrode, wherein the gate is connected with the first scan line Scan1, the first electrode is connected with the second node B, and the second electrode is grounded.

The present embodiment further provides a pixel unit comprising an OLED and the above pixel unit driving circuit connected therewith.

The present embodiment further provides a display apparatus comprising a plurality of above pixel units arranged in a matrix.

Figure 9:
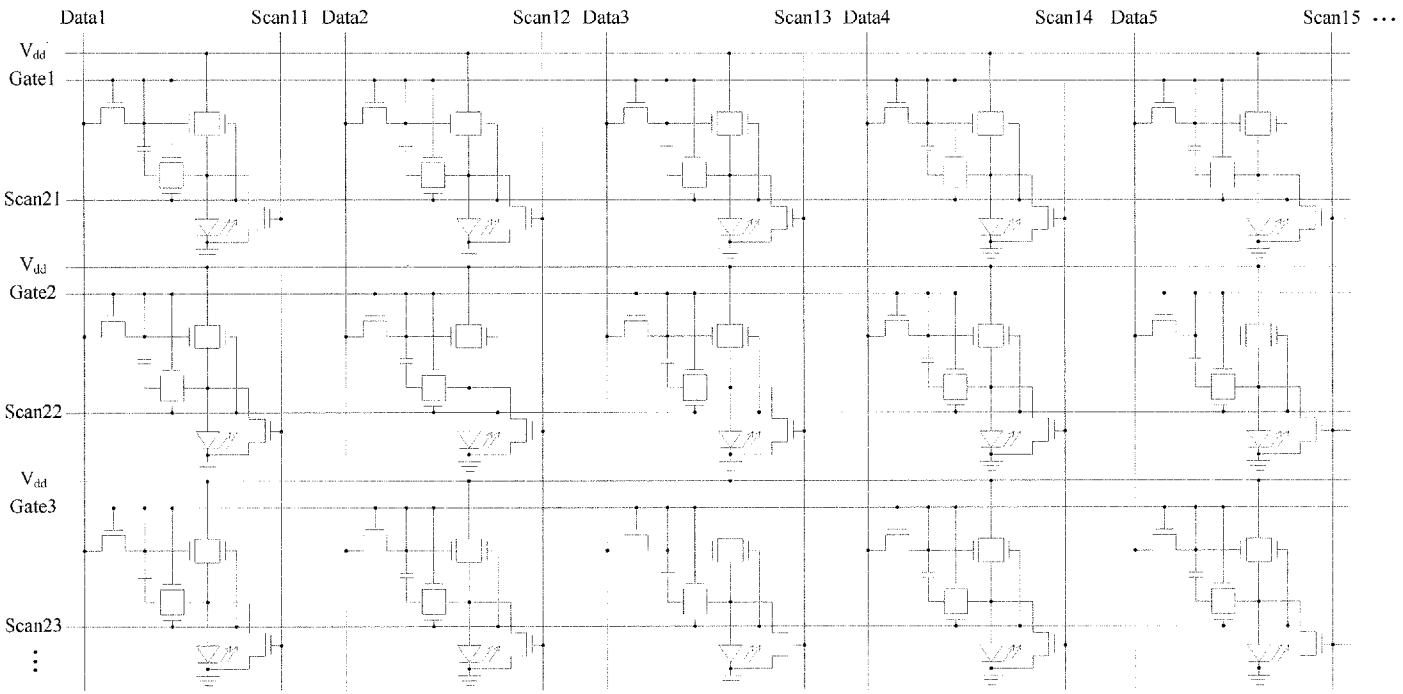
FIG. 9 is a schematic diagram illustrating a matrix structure composed of the pixel unit driving circuits s and OLEDs connected therewith according to the Embodiment 3 of the present disclosure.

A matrix composed of the pixel unit driving circuits and the OLEDs connected therewith according to the present embodiment is as illustrated in FIG. 9, and the display apparatus comprises the matrix of the pixel unit driving circuits and the OLEDs connected with the respective the pixel unit driving circuits. In FIG. 9, Datan denotes the nth data line connected with the pixel unit driving circuits in the nth column, Gaten denotes the nth control line connected with the pixel unit driving circuits in the nth line, Scan1*n* denotes the nth first scan line connected with the pixel unit driving circuits in the nth column, and Scan2*n* denotes the nth second scan line connected with the driving circuits for the pixel units in the nth column, wherein n is a nature number.

Figure 10:
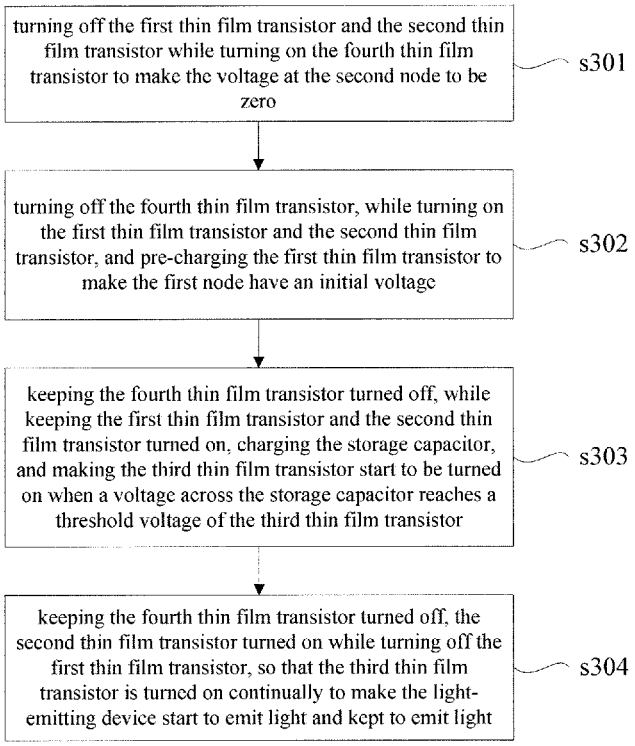
FIG. 10 is a flowchart illustrating a pixel unit driving method according to the Embodiment 3 of the present disclosure.

As illustrated in FIG. 10, the present embodiment further provides a pixel unit driving method, which is applied to the above pixel unit driving circuit, and the driving method performs operation processes as follows.

In a step s301, the first thin film transistor T1 and the second thin film transistor T2 are turned off while the fourth thin film transistor T4 is turned on so that the voltage at the second node B is zero.

In particular, the high level signal is inputted through the first scan line Scan1, while the low level signals are inputted through the control line Gate, the data line Data and the second scan line Scan2.

In a step s302, the fourth thin film transistor T4 is turned off, while the first thin film transistor T1 and the second thin film transistor T2 are turned on, the first thin film transistor T1 is pre-charged so that the first node A has an initial voltage.

In particular, the high level signal is inputted through the control line Gate, while the low level signals are inputted through the data line Data, the first scan line Scan1 and the second control line Scan2.

In a step s303, the fourth thin film transistor T4 is kept turning off, while the first thin film transistor T1 and the second thin film transistor T are kept turning on, the storage capacitor Cs is charged, and the third thin film transistor T3 is started to be turned on when a voltage across the storage capacitor Cs reaches a threshold voltage $V_{th(T3)}$ of the third thin film transistor T3.

In particular, the high level signals are inputted through the control line Gate and the data line Data, while the low level signals are inputted through the first scan line Scan1 and the second scan line Scan2.

In a step s304, the fourth thin film transistor T4 is kept turning off, the second thin film transistor T2 is kept turning on while the first thin film transistor T1 is turned off, so that the third thin film transistor T3 is turned on continually to make the light-emitting device start to emit light and kept to emit light.

In particular, the high level signals are inputted through the data line Data and the second scan line Scan2, while the low level signals are inputted through the control line Gate and the first scan line Scan1.

An operation principle of the pixel unit driving circuit and the driving method according to the present embodiment will be described below in connection with the timing control diagram shown in FIG. 11.

Figure 11:
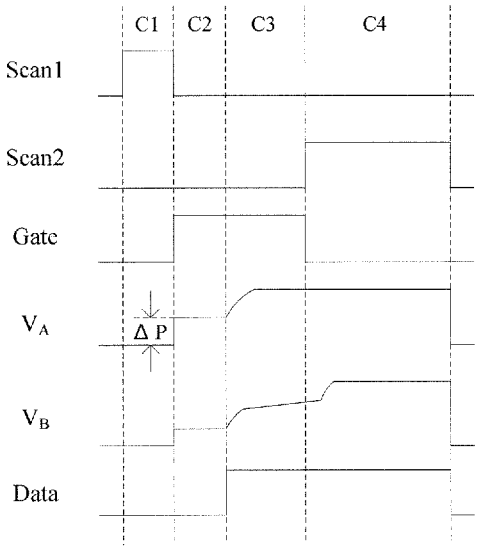
FIG. 11 is a timing control diagram of the pixel unit driving circuit shown in FIG. 8.

The timing control diagrams shown in FIG. 11 are divided into four stages, a charge releasing stage, a pre-charging stage, a data writing stage, and a driving and light-emitting stage, respectively, which are marked as C1, C2, C3 and C4 in FIG. 11, respectively.

Stage C1 (Charge Releasing Stage)

The high level signal is inputted through the first scan line Scan1, while the low level signals are inputted through the control line Gate, the data line Data and the second scan line Scan2, so that the first thin film transistor T1 and the second thin film transistor T2 are turned off while the fourth thin film transistor T4 is turned on, the second node is grounded, thereby charges at the second node B are released and the voltage at the second node B is zero, which ensures that no residual voltage or charge exists at the second node B so as to prevent the residual voltage or charge from affecting gray levels in the next frame of image of the OLEDs and the driving of the OLEDs.

The stage C2 to the stage C4 are identical with the stage B1 to the stage B3 in the Embodiment 3, and details are omitted herein. Further, during the stages C2-C4, the low level signal is inputted on the first scan line Scan1, in order to keep the fourth thin film transistor T4 turned off.

It should be noted that FIG. 11 only illustrates a part of the timing control diagram of the pixel unit driving circuit, and the control line Gate, the data line Data and the second scan line Scan2 will repeat the input timing of the stage C1, the stage C2, the stage C3 and the stage C4 every time the display apparatus displays one frame of image, and so forth.

Other method and functions in the present embodiment are the same as those in the Embodiment 2, and details are omitted herein.

It may be understood that above implementations are only illustrative implementations utilized for explaining the principle of the present invention, however, the present invention is not limited thereto. For those ordinary skilled in the art, many variations or improvements may be made without departing from the spirit and essence of the present invention, and such variations and improvements fall into the protection scope of the present disclosure.

What is claimed is:

1. A pixel unit driving circuit for driving a light-emitting device to emit light, comprising a first thin film transistor, a second thin film transistor, a third thin film transistor and a storage capacitor, wherein the first to third thin film transistors comprise gates, first electrodes and second electrodes;

the gate of the first thin film transistor is connected with a control line, the first electrode thereof is connected with a data line, and the second electrode thereof is connected with a first node;

the second thin film transistor has two gates, one gate thereof is connected with the control line and another gate is connected with a second scan line, the first electrode thereof is connected with the storage capacitor, and the second electrode thereof is connected with a second node;

the third thin film transistor has two gates, one gate thereof is connected with the first node and another gate is connected with the second scan line, the first electrode thereof is connected with a power supply, and the second electrode thereof is connected with the second node;

one terminal of the storage capacitor is connected with the first node, and the other terminal thereof is connected with the first electrode of the second thin film transistor;

one terminal of the light-emitting device is connected with the second node, and the other terminal thereof is grounded, and wherein the second node is a node formed by directly connecting the three terminals of the second electrode of the second thin film transistor, the second electrode of the third thin film transistor and one terminal of the light-emitting device together.

2. The driving circuit according to claim 1, wherein the first node is connected with the control line.

3. The driving circuit according to claim 2, wherein the driving circuit further comprises a fourth thin film transistor having a gate, a first electrode and a second electrode, wherein the gate of the fourth thin film transistor is connected with a first scan line, the first electrode thereof is connected with the second node, and the second electrode thereof is grounded.

4. The driving circuit according to claim 3, wherein, the respective thin film transistors are N-type thin film transistors; and the light-emitting device is an Organic Light-Emitting Diode.

5. The driving circuit according to claim 2, wherein, the respective thin film transistors are N-type thin film transistors; and the light-emitting device is an Organic Light-Emitting Diode.

6. The driving circuit according to claim 1, wherein, the respective thin film transistors are N-type thin film transistors; and the light-emitting device is an Organic Light-Emitting Diode.

7. A pixel unit driving method, which is applied to the pixel unit driving circuit of claim 1, comprising steps of:

A1, turning on the first thin film transistor and the second thin film transistor, charging the storage capacitor, and making the third thin film transistor start to be turned on when a voltage across the storage capacitor reaches a threshold voltage of A2, keeping the second thin film transistor turned on, while turning off the first thin film transistor, so that the third thin film transistor is turned on continually to make the light-emitting device start to emit light and keep to emit light.

8. The driving method according to claim 7, wherein, the first to third thin film transistors are N-type thin film transistors; and the step A1 comprises:

inputting high level signals through the control line and the data line, while inputting a low level signal through the second scan line; and the step A2 comprises:

inputting a low level signal through the control line, while inputting high level signals through the data line and the second scan line.

9. The driving method according to claim 7, wherein the pixel unit driving circuit further a first node connected with the control line; the driving method further comprises a step B1 before the step A1: turning on the first thin film transistor and the second thin film transistor and pre-charging the first thin film transistor to make the first node have an initial voltage.

10. The driving method according to claim 9, wherein, the first to third thin film transistors are N-type thin film transistors; and the step B1 comprises:

inputting a high level signal through the control line, while inputting low level signals through the data line and the second scan line.

11. The driving method according to claim 9, wherein the pixel unit driving circuit further comprises a fourth thin film transistor which includes a gate, a first electrode and a second electrode; the gate of the fourth thin film transistor is connected with the first scan line, the first electrode thereof is connected with the second node and the second electrode thereof is grounded; the driving method further comprises a step C1, before the step B1: turning off the first thin film transistor and the second thin film transistor while turning on the fourth thin film transistor, so that a voltage at the second node is zero.

12. The driving method according to claim 11, wherein the first to fourth thin film transistors are N-type thin film transistors; and the step C1 comprises:

inputting a high level signal through the first scan line, while inputting low level signals through the control line, the data line and the second scan line.

13. A pixel unit comprising a light-emitting device and the pixel unit driving circuit according to claim 1, which is connected with the light-emitting device.

14. The pixel unit according to claim 13, wherein the first node is connected with the control line.

15. The pixel unit according to claim 14, wherein the driving circuit further comprises a fourth thin film transistor having a gate, a first electrode and a second electrode, wherein the gate of the fourth thin film transistor is connected with a first scan line, the first electrode thereof is connected with the second node, and the second electrode thereof is grounded.

16. The driving circuit according to claim 15, wherein, the respective thin film transistors are N-type thin film transistors; and the light-emitting device is an Organic Light-Emitting Diode.

17. The driving circuit according to claim 14, wherein, the respective the thin film transistors are N-type thin film transistors; and the light-emitting device is an Organic Light-Emitting Diode.

18. The pixel unit according to claim 13, wherein, the respective thin film transistors are N-type thin film transistors; and the light-emitting device is an Organic Light-Emitting Diode.

* * * * *